United States Patent [19]

Harrison

[11] 4,232,583

[45] Nov. 11, 1980

[54] FIREARM WITH RECOIL MOVEMENT DELAYING MECHANISM

[76] Inventor: Donald G. Harrison, 5927 W. Rose La. #C, Glendale, Ariz. 85301

[21] Appl. No.: 969,382

[22] Filed: Dec. 14, 1978

[51] Int. Cl.[3] ..... F41D 5/02; F41D 5/04; F41D 11/06

[52] U.S. Cl. ..... 89/153; 89/173; 89/187 CB

[58] Field of Search ..... 89/152, 153, 173, 180, 89/187 CB

[56] References Cited

U.S. PATENT DOCUMENTS

| | | | |
|---|---|---|---|
| 691,040 | 1/1902 | Young | 89/153 |
| 908,631 | 1/1909 | Warnant-Creon | 89/153 |

*Primary Examiner*—Stephen C. Bentley
*Attorney, Agent, or Firm*—Herbert E. Haynes, Jr.

[57] ABSTRACT

Automatic or semiautomatic firearms which operate on the blowback principle are equipped to fire more powerful cartridges by the provision of a simple lightweight mechanical recoil movement delaying mechanism which increases the breech opening delay time so that the higher gas pressure in the weapon's firing chamber resulting from the use of more powerful cartridges will have time to drop to a safe level. A second embodiment of the recoil movement delaying mechanism is employed to provide a simple inexpensive locking device for use on automatic or semiautomatic firearms which operate on the locked breech principle.

12 Claims, 14 Drawing Figures

120
122
124
126
127
128
129
130
132
134
136
137
138
139
140
142
143
144
145
147
150
152
154
156
158
160
162
164
166
168
170

FIREARM WITH RECOIL MOVEMENT DELAYING MECHANISM

BACKGROUND OF THE INVENTION

1. Field of the Invention

This invention relates to firearms and more particularly to a firearm of the automatic or semiautomatic type having a mechanical recoil movement delaying mechanism which delays breech opening until gas pressure drops to a safe level.

2. Description of the Prior Art

Automatic and semiautomatic firearms of the type having a reciprocating breechblock, or slide, function on a long established well known principle in which forward, or loading, movement of the breechblock will pick up a single cartridge from the weapon's magazine, load the cartridge into the firing chamber and close the breech. Subsequent to firing, the breechblock moves backward, or recoils, and such recoil movement extracts the empty cartridge case from the firing chamber, ejects it from the weapon and simultaneously cocks the hammer.

In this type of reciprocating breechblock action, it is necessary to provide some means for delaying recoil movement of the breechblock subsequent to firing to allow gas pressure in the weapon's firing chamber to drop to a safe level. Typically, breechblock mechanisms fall into two commonly used categories and a third less commonly employed category.

The first commonly used type of reciprocating breechblock mechanism is referred to as a blowback operated mechanism. Briefly, in firearms operating on the blowback principle, the mass of the breechblock in conjunction with a recoil spring are employed to retard the backward thrust of the fired cartridge case, and thus, delay breech opening long enough to allow the gas pressure in the firing chamber to drop to a safe level. This operating principle is usually employed only on weapons firing low to medium powered cartridges, in that a larger more powerful cartridge with higher gas pressure would require heavier breechblocks and recoil springs, and those factors defeat the purpose of keeping such firearms as lightweight and compact as possible.

The second commonly used type of reciprocating breechblock mechanism is referred to as a locked breech mechanism. In firearms operated on the locked breech principle, the breechblock and the barrel, having the firing chamber therein, are mechanically locked together during firing and are unlocked, usually by recoil or gas pressure, subsequent to the firing. In weapons that are unlocked by recoil, the mechanically locked breechblock and barrel recoil as a single entity subsequent to firing for a predetermined distance, and will be unlocked when the barrel or breechblock moves into contact with some form of decoupling device such as a deflecting cam surface formed in the weapon's receiver or frame. When the barrel or breechblock contacts the decoupling device, the breechblock is then unlocked and will continue to recoil until the breech is opened. Weapons operating on the recoil principle are relatively costly to manufacture and are relatively complex due to the configurations of the various types of mechanical locking devices and decoupling devices and the costs for machining those devices.

In weapons that are unlocked by gas pressure, the breechblock, or bolt, is mechanically locked to the barrel to close the breech, such as by inclined or cam surfaces which cause the bolt to be deflected or rotated into engagement with locking grooves or the like formed in the weapon. A spring biased piston is coupled to the breechblock or bolt, and subsequent to firing of the weapon, expanding gas pressure is ported to move the piston in a manner so that it unlocks the bolt so that it is free to recoil thus opening the breech. As was the case with weapons that are unlocked by the recoil principle, weapons that are unlocked by gas pressure are relatively expensive to manufacture and are relatively complex due to the configurations of the various types of mechanical locking devices and the costs for machining those devices.

In either case, the locked breech operating principle is normally used only on relatively large weapons which fire medium to high power cartridges in that the mass, weight, complexity and costs of locked breech mechanisms makes their use on relatively small weapons firing medium to low power cartridges impractical and unnecessary.

The third less commonly employed type of reciprocating breechblock mechanism is referred to as a half locked, retarded blowback or hesitation blowback action. In this third operating principle, the mass of the breechblock and the biasing of the recoil spring are employed in conjunction with some form of mechanical delaying means which must be overcome before recoil movement of the breechblock can commence. Such delaying means have taken many forms, such as spring biased levers which are in engagement with the breechblock, and in general the complexity, mass, and the like, of such devices is responsible for their lack of widespread usage.

From the above, it will be seen that the various types of breechblock mechanisms have been designed to suit the power of the cartridges fired, and these mechanisms in turn are a determining factor as to the size, weight, serviceability, cost and complexity of the weapon in which they are used. Therefore, a need exists for a new and useful recoil movement delaying mechanism which, in a first embodiment thereof, allows higher powered cartridges to be used in relatively small and compact automatic or semiautomatic weapons that operate on the blowback principle, and in a second embodiment provides a simple low cost breech locking mechanism for use on relatively large automatic or semiautomatic weapons which operate on the locked breech principle.

SUMMARY OF THE INVENTION

In accordance with the present invention, a new and useful recoil movement delaying mechanism is disclosed for use in automatic or semiautomatic firearms. In a first embodiment, the recoil movement delaying mechanism of the present invention is employed on relatively small weapons to allow the use of higher powered cartridges in such weapons, and in a second embodiment it provides a simple low cost breech locking mechanism for use on relatively large weapons.

In the first embodiment of the present invention, the recoil movement delaying mechanism is designed to operate in conjunction with automatic or semiautomatic firearms which operate on the blowback operating principle. It will be noted that addition of the recoil movement delaying mechanism to a firearm operating on the blowback principle results in that firearm being classified as operating in accordance with the hereinbefore described category referred to as a hesitation blowback action. The recoil movement delaying mechanism of this embodiment increases the delay time provided by the mass of the breechblock and the recoil spring so that higher power cartridges may be employed in firearms which, without this mechanism, would be limited to the use of lower powered cartridges. The recoil movement delaying mechanism includes a roller which is movably held in a pair of spaced apart opposed inclined grooves formed in the upper rear portion of the weapon's frame. The roller is disposed transversely with respect to the reciprocal movement path of the breechblock, and is movable into and out of that path at different times during the weapon's operation by interaction of the roller with the weapon's hammer and breechblock. When the hammer falls during firing of the firearm, a cam surface provided on the hammer will drive the roller upwardly into the movement path of the breechblock, and will hold the roller in wedged bearing engagement with an inclined surface provided on the rear portion of the breechblock. The angular relationship of the inclined grooves relative to the inclined surface of the breechblock in conjunction with the profile of the hammer's cam surface, provide a mechanical disadvantage, when the roller is in the upwardly wedged position, which must be overcome by the recoiling breechblock. When the breechblock attempts to commence its recoil movement, the inclined surface thereof exerts a force on the roller and drives it downwardly along the cam surface of the hammer, and when the roller has moved out of the movement path of the breechblock, recoil movement of the breechblock will occur in the normal manner. The time required to overcome the mechanical disadvantage and move the roller will increase the delay time provided by the mass of the breechblock and recoil spring.

In the second embodiment of the present invention, the recoil movement delaying mechanism is designed to operate in conjunction with automatic or semiautomatic firearms which operated in accordance with the recoil operated, or gas operated, locked breech actions. In this second embodiment, the cam surface of the hammer is configured to lockingly wedge the roller in the movement path of the breechblock, and this locked relationship will be maintained until the hammer is rotated, either by the weapon's gas operated device, or the recoil operated device, through a portion of its cocking movement. When the hammer is thus rotated, the inclined surface of the breechblock will drive the roller downwardly along the hammer's cam surface and out of the movement path of the recoiling breechblock.

Accordingly, it is an object of the present invention to provide a new and improved reciprocating breechblock mechanism of the type used in automatic and semiautomatic firearms.

Another object of the present invention is to provide a new and useful recoil movement delaying mechanism for use in automatic and semiautomatic firearms, to increase the breech opening delay so that cartridges of higher power may be utilized therein.

Another object of the present invention is to provide a new and useful recoil movement delaying mechanism for use in automatic and semiautomatic firearms to increase the breech opening delay so that cartridges of higher power may be utilized therein, with this mechanism being a simple lightweight mechanical device.

Another object of the present invention is to provide a new and useful recoil movement delaying mechanism for use on automatic and semiautomatic firearms which function in accordance with the blowback operating principle.

Another object of the present invention is to provide a new and useful recoil movement delaying mechanism for use on automatic and semiautomatic firearms which function in accordance with the blowback operating principle with that mechanism providing a mechanical disadvantage that the recoiling breechblock must overcome before breech opening occurs.

Another object of the present invention is to provide a new and useful recoil movement delaying mechanism for use on automatic and semiautomatic firearms which function in accordance with the locked breech operating principle.

Another object of the present invention is to provide a new and useful recoil movement delaying mechanism for use on automatic and semiautomatic firearms which function in accordance with the locked breech operating principle, wherein the mechanism locks the breechblock in the closed position and requires that the weapon's hammer be rotated toward the cocked positon before breech opening can occur.

Still another object of the present invention is to provide a new and useful recoil movement delaying mechanism for use on automatic and semiautomatic firearms, with this mechanism including a movable roller that is movable into and out of the movement path of the reciprocally operable breechblock at different times during the operation of the firearm, with such movement resulting from interaction of the roller with a cam surface formed on the weapon's hammer and an inclined surface formed on the rear of the breechblock of the firearm.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
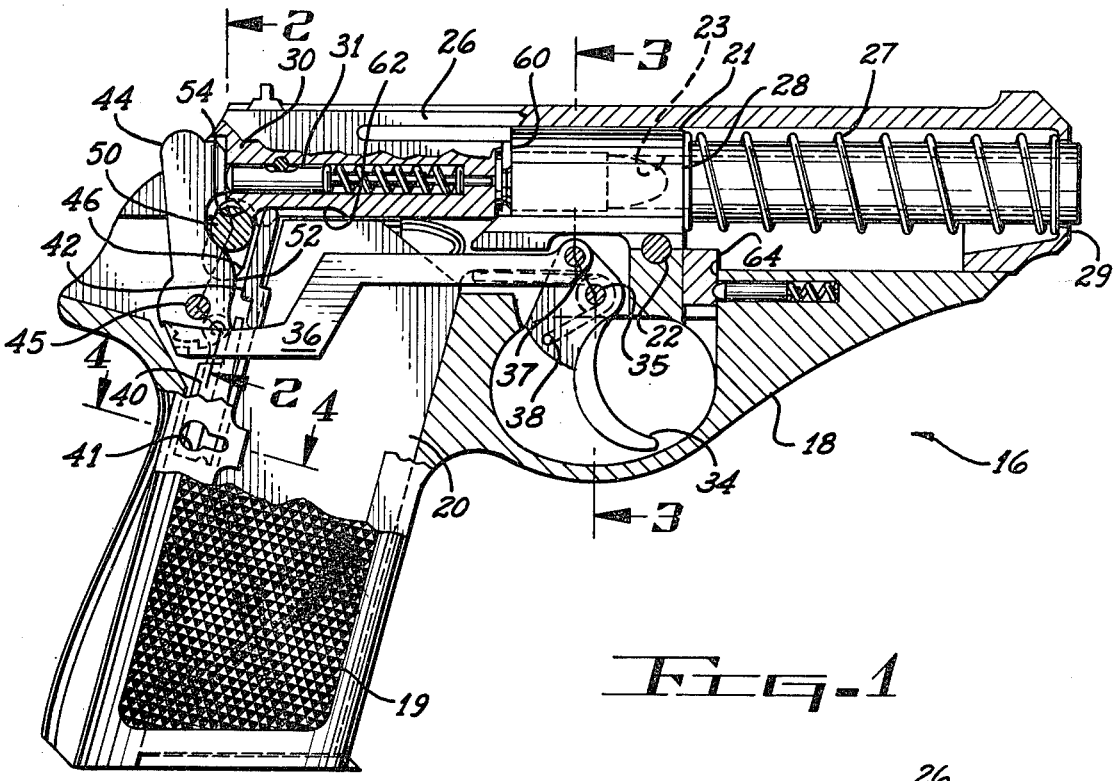
FIG. 1 is a side view of the semiautomatic firearm with portions thereof in section and broken away to illustrate a first embodiment of the recoil movement delaying mechanism of the present invention, along with other components of the firearm.
Figure 2:
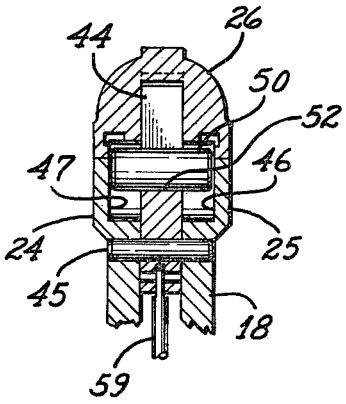
FIG. 2 is a fragmentary sectional view taken along the line 2—2 of FIG. 1.
Figure 3:
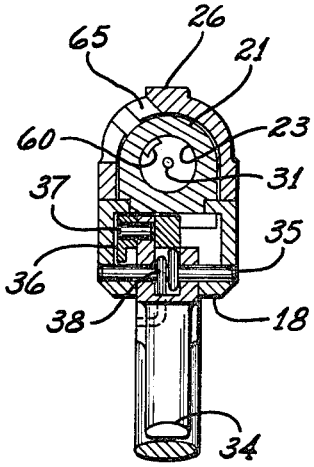
FIG. 3 is a fragmentary sectional view taken along the line 3—3 of FIG. 1.
Figure 4:
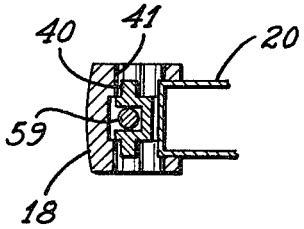
FIG. 4 is a fragmentary sectional view taken along the line 4—4 of FIG. 1.

Referring more particularly to the drawings, FIGS. 1 through 4 illustrate a semiautomatic firearm which is indicated generally by the reference numeral 16, with the firearm 16 including the recoil movement delaying mechanism of the present invention. It will be understood that the firearm 16 is typical of a great variety of such weapons all of which operate in accordance with the same basic operating principles but differ as to the structural details from one model to another and from one manufacturer to another. Therefore, the particular firearm 16, as illustrated and hereinafter described, is not to be construed as a limitation of the present invention, in that the recoil movement delaying mechanism can be employed on all weapons that operate in accordance with the same basic principles.

The firearm 16 includes the usual frame 18 having a handle 19 in which the cartridge clip or magazine 20 is removably mounted. The barrel 21 is affixed atop the weapon's frame 18 by a suitable pin 22 with the barrel having the usual cartridge chamber 23 formed in the rearmost portion of the barrel. The frame 18 is provided with an upstanding spaced apart pair of longitudinally extending flanges or shoulders 24 and 25 (FIG. 2) upon which a breechblock, or slide, 26 is carried so as to be reciprocally movable in a path that extends longitudinally of the weapon. A recoil spring 27 is in a coaxially wrapped around position with respect to the barrel 21 and is disposed so that one end of the spring bears against a shoulder 28 formed on the barrel, and the opposite end bears against an end wall 29 of the slide 26. The recoil spring 27 is provided to bias the slide toward its forwardly disposed, or closed, position as shown in FIG. 1, and is employed to return the slide to the closed position subsequent to its recoil movement as will hereinafter be described in detail. The slide 26 is formed with an enlarged metallic block 30 at its rearmost end, and that block 30 carries the firing pin assembly 31 in the usual manner. In addition to carrying the firing pin assembly 31, the block 30 is configured to perform other functions during the operation of the firearm 16 as will hereinafter be described in detail.

The weapon's frame 18 has the usual trigger mechanism 34 pivotably mounted therein on a suitable pivot pin 35, and the trigger 34 is in turn coupled to the trigger drawbar 36 by another pin 37. A trigger spring 38 is mounted in the conventional manner so as to bias the trigger 34 to the forwardly disposed position thereof and bias the drawbar 36 to the upwardly disposed position. As is customary, the firearm 16 is also provided with a spring-loaded sear 40, which is pivotably carried in a pivot slot 41 provided in the frame 18, and a drawbar disconnector member 42. The drawbar 36, the sear 40 and the disconnector member 42 all interact to effect proper operation of the weapon's hammer 44, as will become apparent as the following description progresses. The hammer 44 is pivotably mounted on a suitable pin 45 at the rear of the weapon's frame as is customary.

In accordance with the present invention, the above described typical type of semiautomatic firearm 16 is provided with a spaced apart opposed pair of upwardly angularly inclined grooves 46 and 47 at the rear upper portion of the frame 18. The groove 46 is formed, such as by machining in the upstanding shoulder 24 of the weapon's frame 18, as seen best in FIG. 2, and the opposite groove 47 is similarly formed in the other upstanding shoulder 25. A roller 50 is disposed transversely of the frame 18 with the opposite ends of the roller 50 each being disposed in different ones of the grooves 46 and 47, and, as will hereinafter be described, the roller is reciprocally movable in those grooves by a cam surface 52 formed on the hammer 44, and by an angularly downwardly and forwardly inclined surface 54 formed at the lower rear edge of the block 30 of the slide 26.

Referring now to FIGS. 5 through 8, wherein an operating cycle of the firearm 16 is illustrated to show the weapon's normal operation, and to show how the recoil movement delaying mechanism of the present invention interacts with that operation.

Figure 5:
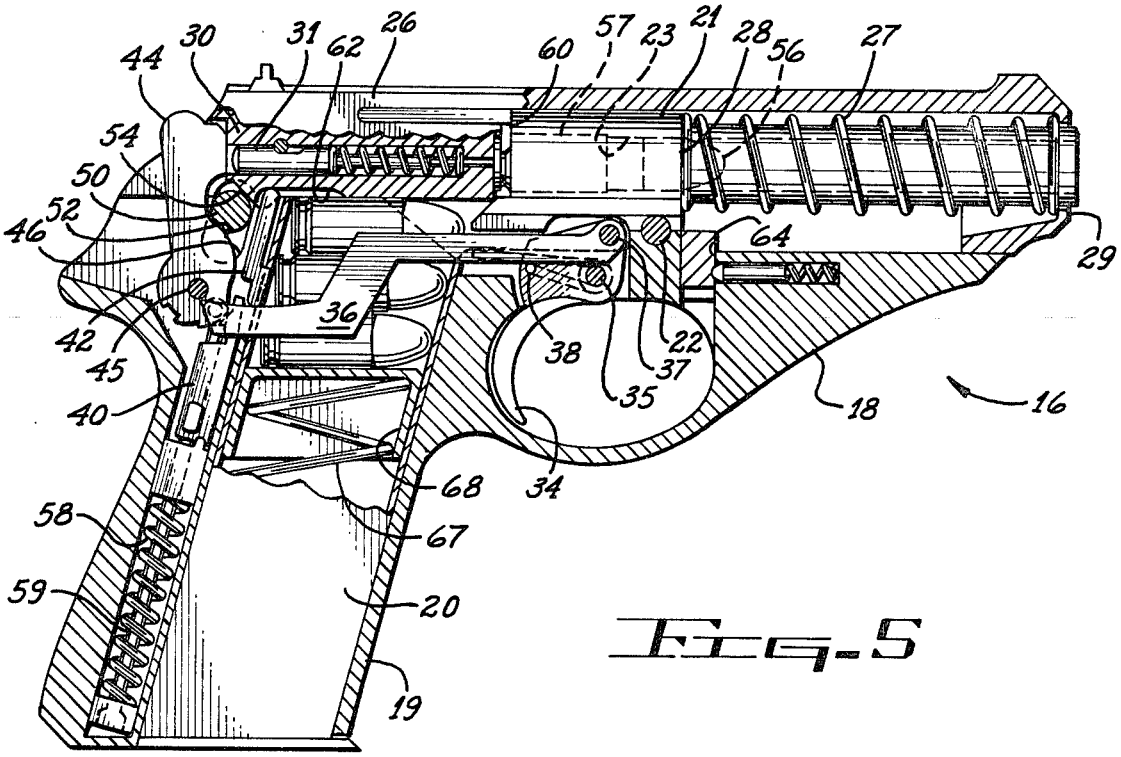
FIG. 5 is a side view similar to FIG. 1 and illustrating the positions of the weapon's components an instant after the weapon has been fired.

FIG. 5 illustrates the firearm an instant after firing of a cartridge, the bullet 56 has left the cartridge case 57 and is starting to move down the barrel 21. It will be noted that gas pressure, resulting from ignition of the cartridge, is at its maximum pressure at this point in time and is propelling the bullet 56, and is also exerting a recoil force on the cartridge case 57, and thus the entire breechblock 26. Firing of the weapon 16 is accomplished in the conventional manner by pulling the trigger 34 to the rear so that it pivots about the pin 35. Pivotal movement of the trigger causes the drawbar 36 to move forwardly and in doing so, the drawbar will move the sear 40 to disengage it from the hammer 44. The hammer, which was being held in the cocked position by the sear 40, is now free to fall under the influence of the hammer spring 58 and connector rod 59. The falling hammer strikes the firing pin assembly 31 carried in the block 30, and drives the firing pin forward into engagement with the cartridge's primer (not shown) which fires the weapon. The breechblock, or slide, 26 is just starting its recoil movement, as a result of the force exerted by the gas pressure as described above. Before the recoil movement can start, inertia of the slide 26 and the bias of the recoil spring 27 must be overcome, as is normal in a weapon of this type. Therefore, the firearm will be seen to have a built-in delay. However, to augment this built-in delay, and thus allow the firing of higher power cartridges, the recoil movement of the breechblock 26 must also overcome a mechanical disadvantage provided by the recoil movement delaying mechanism of the present invention. When the hammer 44 falls to fire the weapon, the cam surface 52 formed on the leading edge of the hammer will drive the roller 50 upwardly in the grooves 46 and 47 and will wedgingly hold it in bearing engagement with the inclined surface 54 formed on the block 30. The force exerted by the recoiling breechblock is exerted on the roller 50 and, due to the angular inclined disposition of the grooves 46 and 47, will result in a force line that coextends with the length of the grooves 46 and 47 so that the roller 50 bears upon the cam surface 52 of the hammer 44. The angular relationship of the cam surface 52 with the force line applied by the roller 50, at the point where the roller bears on the cam surface, results in an under center relationship between that force line and the counteracting force provided by the mass of the hammer and the bias of the hammer spring 58. Since the force applied by the recoiling breechblock is considerably stronger than the counteracting force applied by the hammer, the roller 50 will cause the hammer to be pivotably moved toward its cocked position, and as the hammer is so moved, it will allow the roller 50 to drop down in the inclined grooves 46 and 47. After a predetermined length of time, which is determined by many factors, such as gas pressure, the angular relationship between the inclined grooves and inclined surface of the breechblock, the cam profile, hammer mass, and the hammer spring, the roller 50 will have moved downwardly out of the movement path of the recoiling breechblock 26, and it will then be free to complete its recoil movement in the normal manner.

Figure 6:
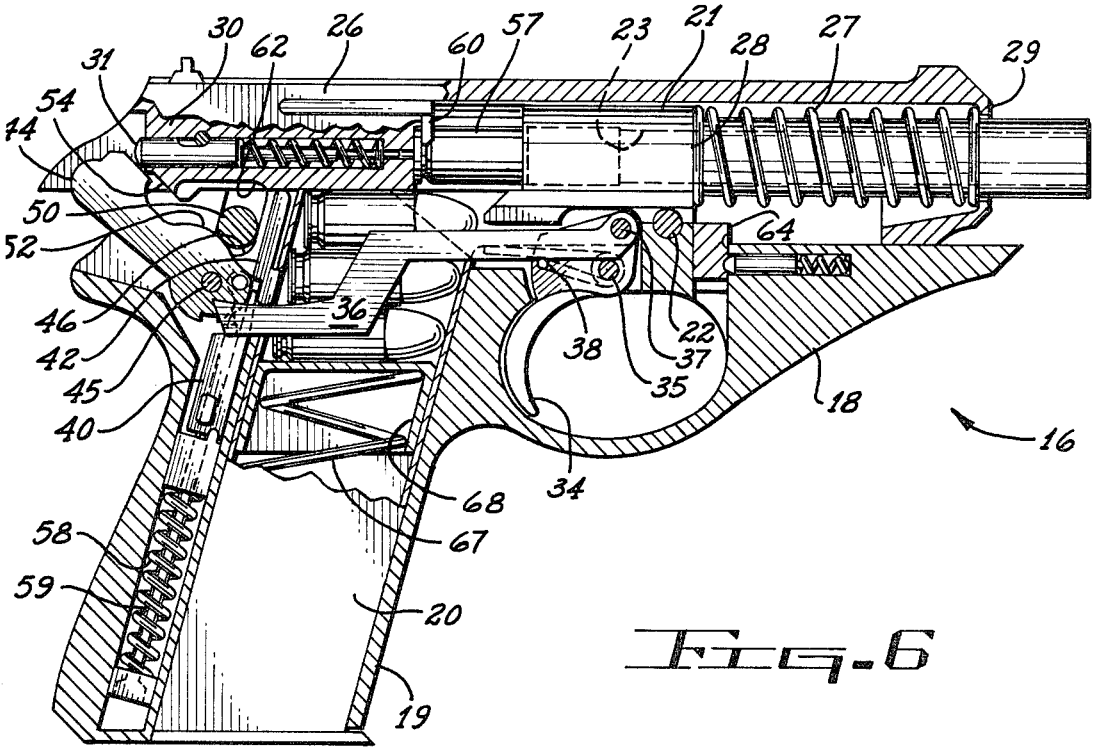
FIG. 6 is a side view similar to FIG. 1 and illustrating the positions of the weapon's components in a partially recoiled position.

FIG. 6 shows the breechblock, or slide 26 in the partially recoiled position, the bullet 56 (FIG. 5) has left the barrel 21, thus resulting in a drop in the gas pressure to a safe level, and the cartridge case 57 is carried rearwardly by the usual extractor mechanism 60. In this partially recoiled position, the disconnector clearance slot 62 formed on the underside of the block 30, has moved rearwardly of the disconnector member 42 so that the block 30 forces the disconnector down which results in downward pivotal movement of the trigger drawbar 36 about the pin 37. This movement of the drawbar will free the sear 40 so that it can move, as a result of its spring bias, to hold the hammer 44 in the fully cocked position once the hammer reaches that position. The roller 50 having been forced down by the recoiling slide 26 is now falling, under the influence of gravity, toward the lowermost point in the opposed grooves 46 and 47.

Figure 7:
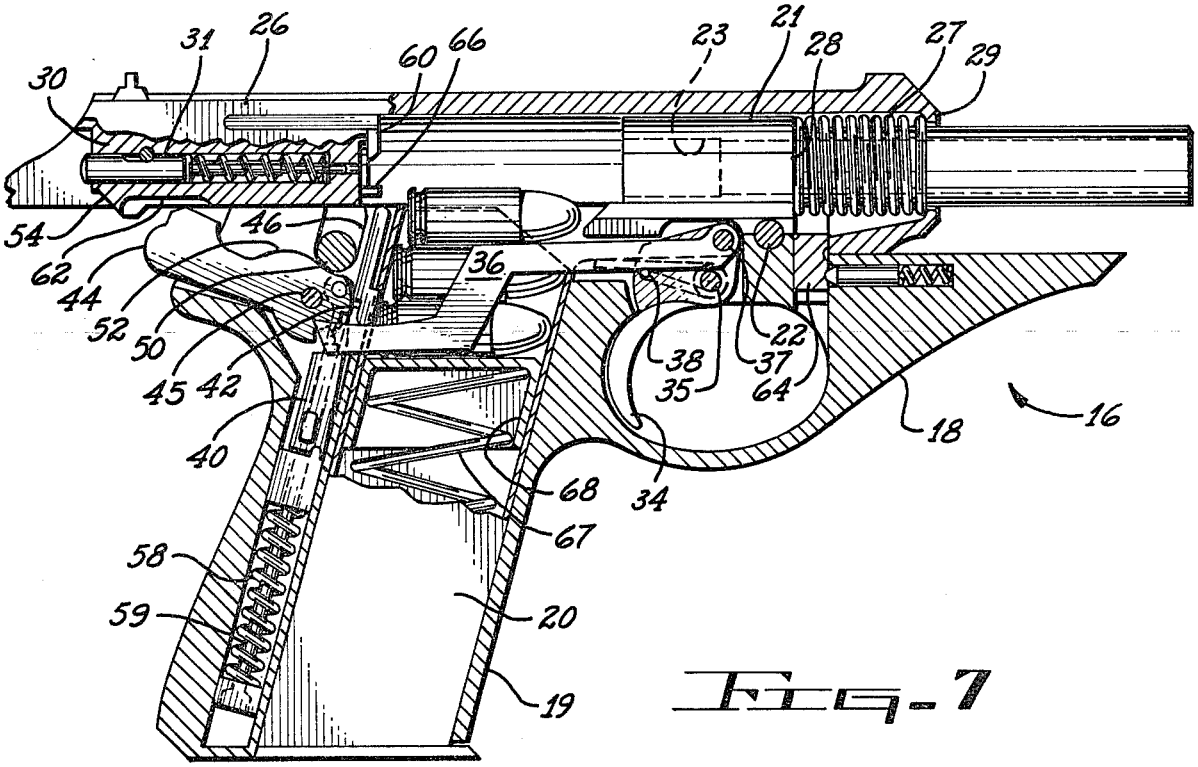
FIG. 7 is a side view similar to FIG. 1 and illustrating the relative positions of the weapon's components in the fully recoiled position.

FIG. 7 shows the firearm 16 in the fully recoiled position wherein the hammer 44 has been moved to its fully cocked position, and the sear 40 is positioned to hold the hammer in that position until the next time the trigger 34 is pulled to fire the weapon. The rearward movement of the breechblock 26 is stopped by its having moved into engagement with the recoil-takedown block 64, which is mounted in the frame 18 forward of the trigger mechanism 34. During movement of the slide 26 from the partially recoiled position shown in FIG. 6, to the fully recoiled, or open position, shown in FIG. 7, the cartridge case 57 (FIG. 6) was extracted from the chamber 23 and ejected from the weapon through the ejection port 65 (FIG. 3) provided in the slide 26 by normal operation of the extractor 60 and the ejector plunger 66 (FIG. 7). Once the cartridge case 57 (FIG. 6) has cleared the weapon, the magazine spring 67 and follower 68 moves the top cartridge in the clip 20 upwardly into a feed position.

Figure 8:
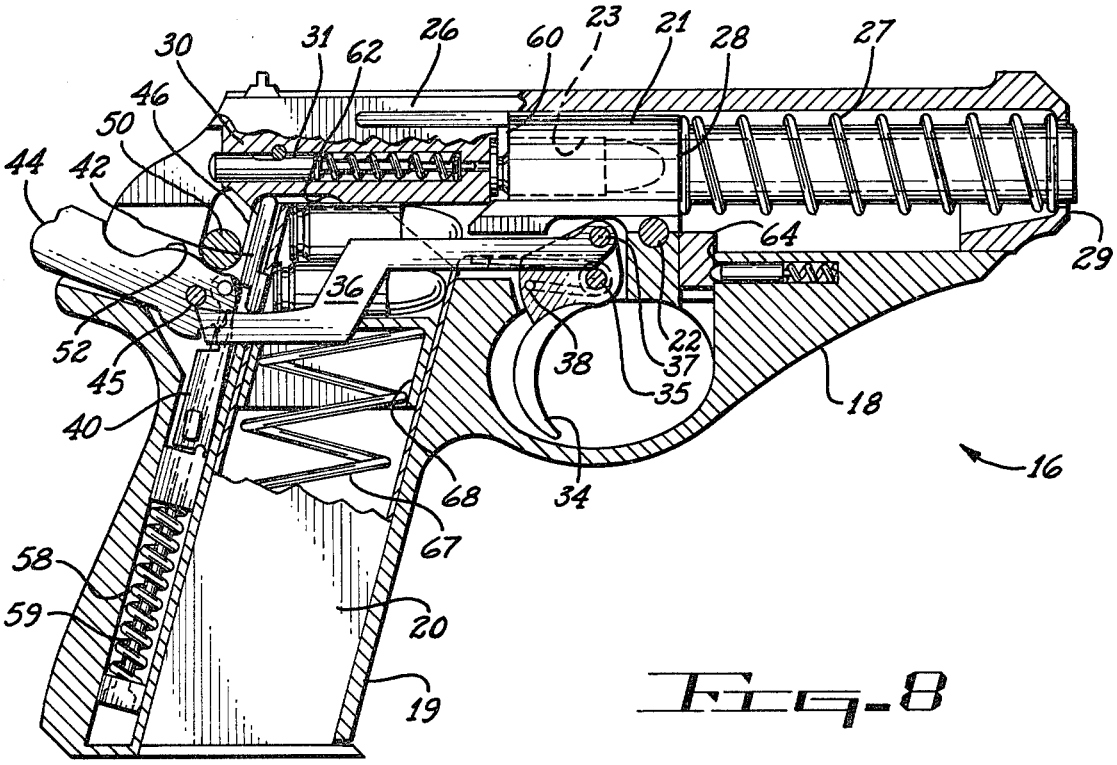
FIG. 8 is a side view similar to FIG. 1 and illustrating the relative positions of the weapon's components in the loaded ready-to-fire position.

FIG. 8 shows the weapon 16 as having been returned to its fully closed, ready to fire position. The recoil spring 27 moves the slide to its forward position and in so moving, the slide picks up the top cartridge in the clip 20 and moves it into the firing chamber 23 of the barrel 21. The sear 40 is positioned so as to hold the hammer 44 in the fully cooked position, and with the return of the slide 26 to its forward position and the release of the trigger 34, the relationship between the drawbar 36, hammer 44, disconnector member 42, and trigger 34 are such that simply pulling the trigger will fire the weapon. It will be noted that in this ready to fire position, the roller 50 is at the lowermost point in the grooves 46 and 47 and is resting on the lowermost part of the cam surface 52 of the hammer 44, so that when the weapon is fired, the falling hammer will cam the roller upwardly thus driving it into the position shown in FIG. 5.

Figures 9, 10, 11:
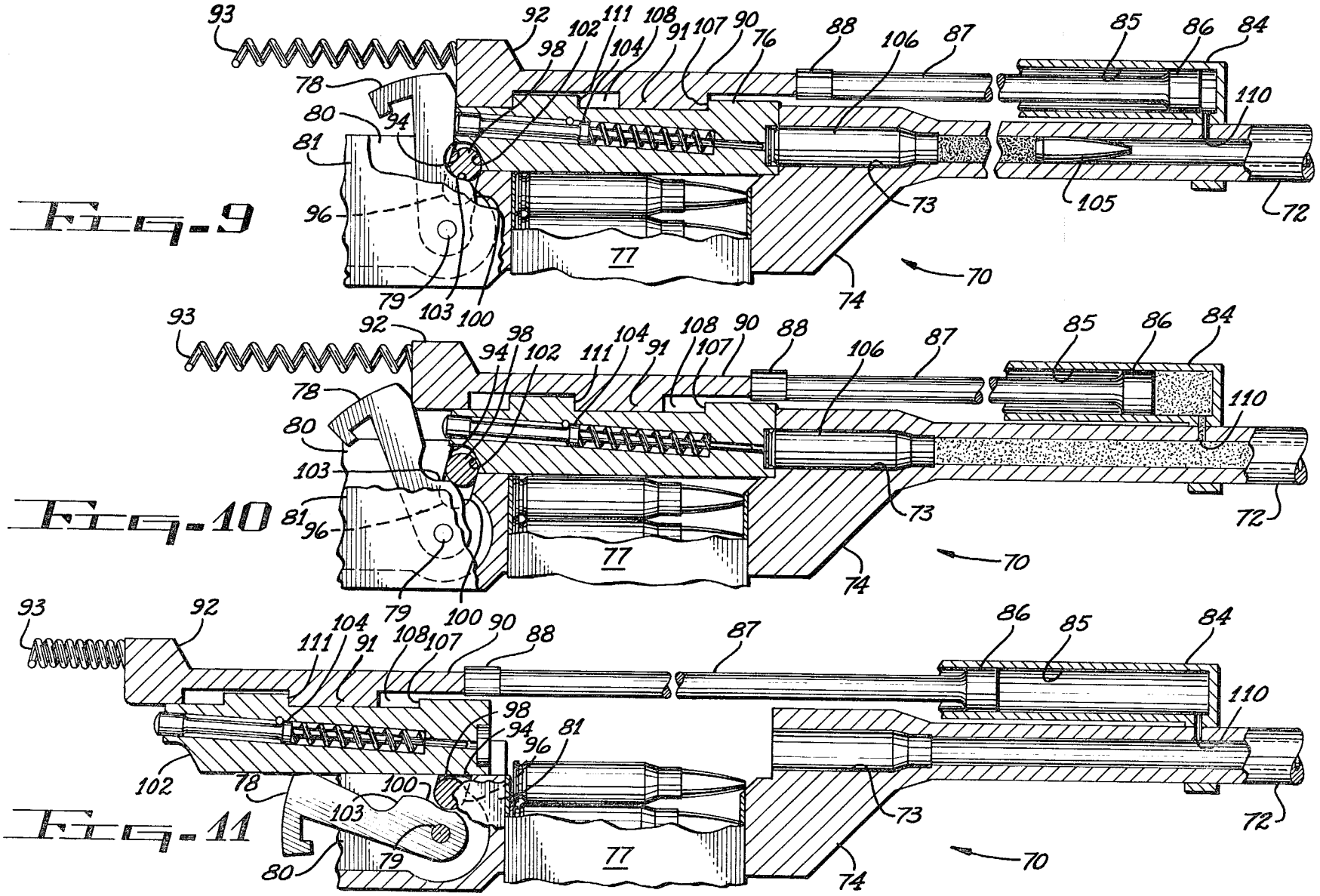
FIG. 9 is a fragmentary sectional view of a firearm having a gas operated locked breech action and including a second embodiment of the recoil movement delaying mechanism of the present invention, and this view shows the component positioning of that firearm at an instant after the weapon has been fired.
FIG. 10 is a view similar to FIG. 9 and illustrating the component positioning when the firearm is in the partially recoiled position.
FIG. 11 is a view similar to FIG. 9 and illustrating the component positioning when the firearm is in the fully recoiled position.

Referring now to FIGS. 9, 10 and 11 wherein the second embodiment of the recoil movement delaying mechanism of the present invention is shown in a diagrammatically illustrated gas operated locked breech type of firearm that is indicated generally by the reference numeral 70.

The weapon 70 includes the usual barrel 72 having a cartridge chamber 73 at its rearmost end, and the barrel is shown as being integral with the weapon's frame 74, however any suitable means for attaching the barrel to the frame could be employed. A breechblock, or bolt 76 is slidably reciprocally mounted in the frame 74 immediately behind the cartridge chamber 73, and the bolt 76 is movable between a breech closing position shown in FIGS. 9 and 10, and a breech opening position shown in FIG. 11. A hammer 78 is pivotably mounted on a suitable pivot pin 79 and is disposed behind the usual magazine 77. The hammer pivot pin 79 is carried in a spaced apart pair of upstanding shoulders 80 and 81 formed in the frame 74 so as to span a channel in which the hammer is pivotably movable. The usual hammer operating mechanisms such as the trigger, sear, and associated devices, are not shown, and it will be understood that those mechanisms are conventional as to their configuration and operation and are well known in the art.

The gas operating portions of the firearm 70 include a housing 84 having a cylindrical bore 85 formed therein, and a piston 86 is reciprocally mounted in the bore. A piston rod 87 extends axially from the piston 86 and is connected, as at 88, to a bolt carrier bar 90, which is provided with a depending ear 91 intermediate its opposite ends and an enlarged block 92 at its rearwardly disposed end. The bolt carrier bar 90, the piston rod 87 and the piston are biased toward the forward end of the housing 84 by a spring 93 which has one of its ends in engagement with the block 92 of the bolt carrier bar 90, and has its other end in engagement with a suitable point (not shown).

In accordance with the second embodiment of the present invention the hereinbefore described basically typical type of gas operated locked breech firearm 70 is provided with a spaced apart opposed pair of upwardly angularly and forwardly inclined grooves 94 and 96, each formed in a different one of the spaced shoulders 80 and 81 of the weapon's frame 74. A roller 98 is disposed transversely of the frame 74 with its opposite ends each disposed in a different one of the grooves 94 and 96, and as will hereinafter be described, the roller 98 is reciprocally movable in those grooves 94 and 96 by interaction of the roller with a cam surface 100 formed on the leading edge of the hammer 78, and an angularly downwardly and forwardly inclined surface 102 provided on the rearmost lower edge of the bolt 76.

FIG. 9 shows the firearm 70 an instant after it has been fired by means of the hammer 78 falling against the firing pin assembly 104 carried in the bolt 76. With the hammer 78 in the cocked position (FIG. 11) prior to firing, the roller 98 is at its lowest position in the grooves 94 and 96 and when the hammer falls to fire the weapon, the cam surface 100 moves into engagement with the roller and cams it upwardly into locked bearing engagement with the inclined surface 102 formed on the bolt 76. This second embodiment of the recoil movement delaying mechanism of the present invention derives its breech opening delay by locking of the bolt when in the upwardly disposed position whereas the previously described embodiment derived its breech opening delay by providing a mechanical disadvantage. This locking of the bolt 76 is provided by a modification of the profile of the cam surface 100 formed on the leading edge of the hammer 78. The cam surface 100 is configured with a substantially flat cam segment 103, which is disposed so as to transverse with respect to the movement path of the roller 98 in the grooves 94 and 96 when the hammer is in the upright, or fallen, position. Therefore, with the roller 98 in engagement with the flat segment 103 of the cam surface 100, when the roller is in its uppermost position, it is locked in that position. This will be understood upon considering that the force exerted by the recoiling bolt 76, as will hereinafter be described, produces a force vector which is perpendicular to the flat surface segment 103 and passes through the hammer pivot pin 79. Thus, physical arrangement of the components and the resulting force vector produces an over center locked relationship.

When the weapon 70 is fired and the bullet 105 has left the cartridge case 106, the gas pressure in the weapon 70 will be at its highest point and will propel the bullets 105 and exert a recoil force on the cartridge case and thus the bolt 76. At this point in time, the bolt 76 is locked in its breech closing position, as described above, and the spring 93 is holding the piston 86, piston rod 87 and the bolt carrier bar 90 in their forwardmost position which places the depending ear 91 in bearing engagement with the forward wall 107 of a transverse slot 108 formed in the upper surface of the bolt 76 and places the enlarged block in engagement with the hammer 78.

FIG. 10 shows the weapon 70 in the next phase of its operation wherein, the bullet 105 (FIG. 9) has passed a gas port 110 which communicates between the barrel 72 and the forwardmost end of the bore 85 formed in the housing 84. The expanding gasses in the barrel 72 are ported into the bore 85 and exert a force on the face of the piston 86 causing it to move rearwardly against the bias of the spring 93. This rearward movement of the piston, will, of course, move the bolt carrier bar 90 rearwardly, and this movement is independent of the bolt 76 for a short period of time due to the width of the transverse slot 108 being greater than the length of the depending ear 91. During this period of independent movement of bolt carrier bar 90 will pivotably move the hammer 78 toward its cocked position. When the ear 91 of the bolt carrier bar 90 reaches the rear wall 111 of the slot 108, the flat surface segment 103 of the cam surface 100 will have been moved out from under the roller 98 so that the roller will freely fall toward its lowermost position in the grooves 94 and 96, and such action will allow the bolt 76 and the bolt carrier bar 90 to recoil as a single entity. It will be noted that when the hammer 78 is moved toward its cocked position, by the independent movement of the bolt carrier bar 90, the roller 98 will move out of engagement with the inclined surface 102 of the bolt 76 and will remain disengaged during an initial portion of the bolt's recoil movement toward its breech opening position. At a point in time shortly after that shown in FIG. 10, the recoiling point will move the inclined surface 102 back into engagement with the roller 98 and move it downwardly along the lower portion of the cam surface 100 thus driving the hammer to its fully cocked position.

FIG. 11 shows the firearm 70 in the fully recoiled position, and during movement to that position, the cartridge case 106 (FIG. 10) was extracted from the cartridge chamber 73, by suitable extractor and ejector devices (not shown), and thrown clear of the weapon, and, the magazine 77 has moved the next cartridge into the pickup position ready for chambering during subsequent forward, or closing movement of the bolt 76. The bolt 76 is returned to the closed position by means of the bolt carrier bar 90 which moves forward under the influence of the spring 93 and when the ear 91 reaches the forward wall 107 of the slot 108, the bolt will be carried along with the bolt carrier bar 90 to the closed position. The hammer 78 will remain in the cocked position by action of the sear (not shown) until the weapon is fired again.

Figures 12, 13, 14:
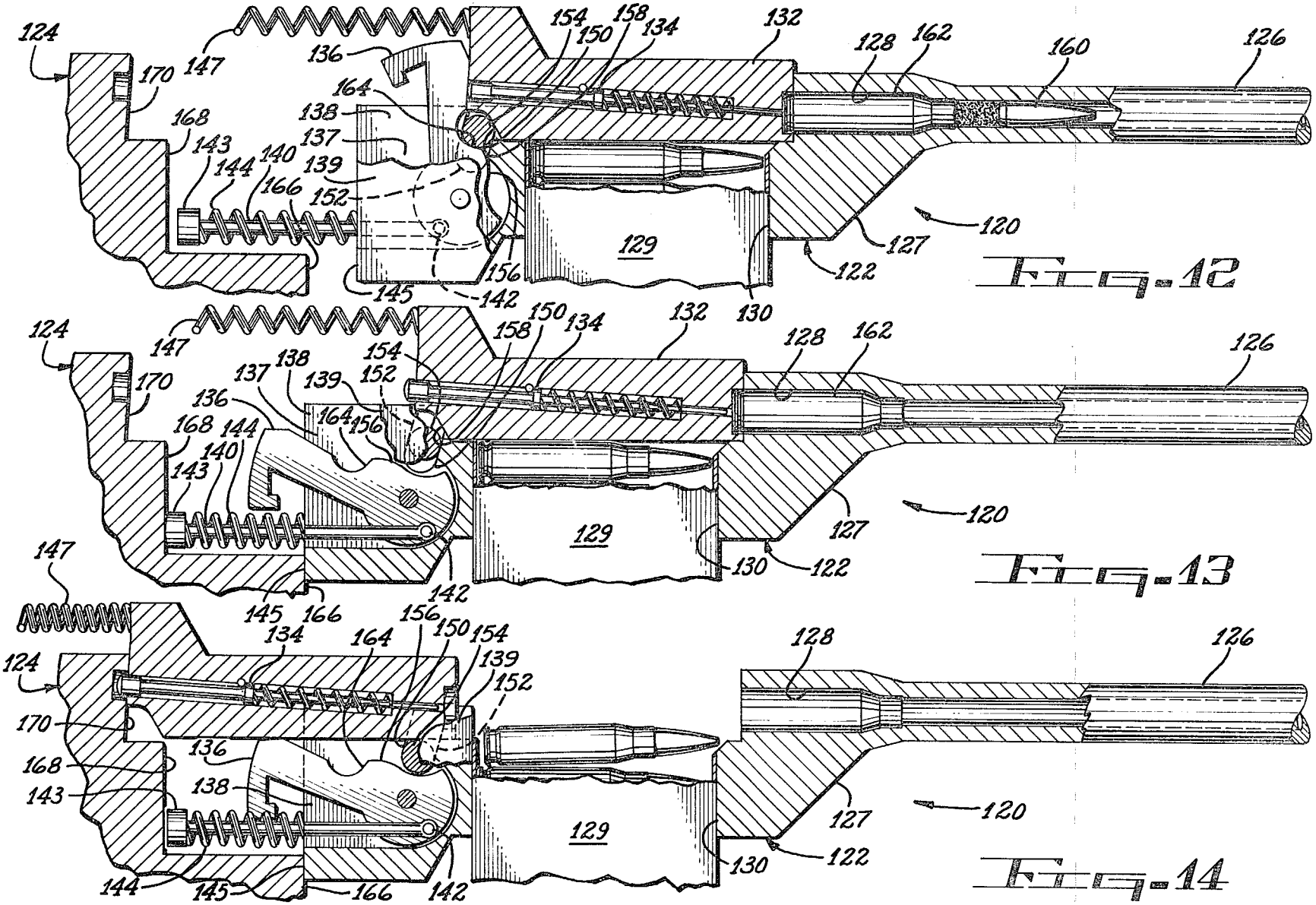
FIG. 12 is a fragmentary sectional view of a firearm having a recoil operated locked breech action, and including the second embodiment of the recoil movement delaying mechanism of the present invention, and this view shows component positions of such firearm an instant after the weapon has been fired.
FIG. 13 is a view similar to FIG. 12 and illustrating the component positioning when the weapon is in the partially recoiled position.
FIG. 14 is a view similar to FIG. 12 and illustrates the component positioning when the weapon is in the fully recoiled position.

Referring now to FIGS. 12, 13 and 14, wherein the second embodiment of the recoil movement delaying mechanism of the present invention is shown in a diagrammatically illustrated recoil operated locked breech type of firearm which is indicated generally by the reference numeral 120.

As is well known in the art, the typical recoil operated firearm 120 includes a barrel assembly 122 which is reciprocally operable in its entirety in a frame or receiver 124. The mounting of the barrel assembly 122 in the receiver 124 is not shown, but will be understood to be conventional in configuration and operation in accordance with techniques well known in the art. The barrel assembly 122 includes the usual barrel 126 extending forwardly of the housing 127, with the barrel having the usual cartridge chamber 128 formed therein. A magazine 129 is positioned in a vertical passage 130 formed in the bottom of the housing 127. A breechblock, or bolt 132, having the usual firing pin assembly 134 mounted therein, is reciprocally mounted atop the housing 127, and is movable between a breech closing position shown in FIG. 12, and a breech opening position shown in FIG. 14 as will hereinafter be described. The weapon's hammer 136 is pivotably mounted in a channel 137 formed in the rear of the housing 127, and that channel is defined, in part, by a spaced apart pair of upstanding shoulders 138 and 139. A hammer strut 140 is eccentrically connected to the hammer 136 by a pin 142 and is disposed so that the strut extends rearwardly from the hammer. The extending end of the hammer strut 140 has an enlargement 143 formed thereon, and a coil spring 144 is coaxially wrapped around the strut so that one end thereof bears against the enlargement 143, and the opposite end bears against the rear wall 145 of the housing 127. In this manner, the hammer 136 is biased to the upright, or fallen position. As hereinbefore mentioned, the barrel assembly 122 is reciprocally movable relative to the receiver 124, and a recoil spring 147 biasingly urges the barrel assembly 122 to its forward position. One end of the recoil spring 147 bears against the rear of the bolt 132, and its opposite end bears against a suitable surface (not shown) in the receiver.

The second embodiment of the recoil movement delaying mechanism of the present invention is identical to that previously described with regard to the weapon 70, except that this mechanism is operated somewhat differently due to the nature of the action of the weapon 120. The opposed pair of upwardly angularly and forwardly inclined grooves 150 and 152, are each formed in a different one of the spaced apart shoulders 138 and 139 of the housing 127. The roller 154 is disposed transversely of the housing 127 with its opposite ends each disposed in a different one of the grooves 150 and 152. As will hereinafter be described, the roller 154 is reciprocally movable in the grooves 150 and 152 by interaction of the roller with the cam surface 156 formed on the leading edge of the hammer 136, and the angularly downwardly and forwardly inclined surface 158 formed on the rear lower edge of the bolt 132.

FIG. 12 shows the weapon 120 an instant after it has been fired by means of the hammer 136 falling against the firing pin assembly 134 with such action firing the weapon to cause the bullet 160 to leave the cartridge case 162. Prior to firing, with the hammer 136 in its cocked position as shown in FIG. 14, the roller 154 will be in its lowermost position in the grooves 150 and 152, and when the hammer falls the cam surface 156 thereof cams the roller upwardly into locked bearing engagement with the inclined surface 158 formed on the bolt 132. As previously described with reference to the weapon 70, the locking action of this second embodiment is derived by the profile of the cam surface. The cam surface 156 formed on the leading edge of the hammer 136 is provided with a substantially flat cam segment 164 which is disposed transverse to the movement path of the roller 154 after the hammer has fallen and will bear against the roller to lock it in its uppermost position.

At the instant after firing, as shown in FIG. 12, the gas pressure in the weapon 120 will be at its maximum which propels the bullet 160 and exerts a recoiling force on the entire barrel assembly 122. The barrel assembly 122, which includes the barrel 126, housing 127, magazine 129, bolt 132, hammer 136 and the recoil movement delaying mechanism of the present invention, will recoil as a single entity with the bolt being held in its breech closing position by virtue of the recoil movement delaying mechanism which locks the bolt 132 in the closed position as described above.

FIG. 13 shows the barrel assembly 122 as having recoiled from its extended position (FIG. 12) as a single entity until the rear wall 145 of the housing 127 strikes a first abutment 166 in the receiver 124 which, of course, stops its recoil movement. Between the instant of firing, and the time when the recoil movement of the barrel assembly is stopped, the hammer strut 140 will strike a second abutment 168 formed in the receiver 124 and the hammer 136 will begin its movement toward the cocked position. When the rear wall 145 of the housing 127 strikes the first abutment 166, the hammer strut 140 will have moved the hammer 136 a sufficient distance so that the flat cam segment 164 will have been moved out from under the roller 154 so that it will now be free to fall to its lowermost position in the grooves 150 and 152 and will exert no further influence on the bolt's movement. Therefore, when the rear wall 145 of the housing 127 moves into engagement with the abutment 166, the recoiling barrel assembly 122 will have imparted sufficient momentum to the bolt 132 to carry it to its fully open position. In doing so, the opening bolt 132 will engage the partially cocked hammer 136 and rotate it to the fully cocked position. The recoil movement of the bolt 132 is stopped when it moves into engagement with a third abutment 170 provided in the receiver 124.

FIG. 14 shows the firearm 120 in the fully recoiled position, which during movement to that position, ejected the empty cartridge case 162 (FIG. 12) by means of a suitable ejector mechanism (not shown), and the magazine 129 moved the next cartridge into the pickup position ready for chambering during subsequent forward movement of the bolt 132. The bolt 132 is moved to its breech closing position by means of the recoil spring 147, and upon engagement of the bolt with the rearmost end, or breech, of the barrel 126, the entire barrel assembly 122 will be moved as an entity to its forward position. The hammer 136 will remain in its cocked position, due to the sear (not shown) until the weapon is fired.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. An automatic or semiautomatic firearm comprising in combination:

(a) a frame;

(b) a recoiling breechlock on said frame and longitudinally reciprocally movable relative to said frame between a breech opening position and a breech closing position;

(c) roller means mounted in said frame and reciprocally movable into and out of the movement path of said recoiling breechblock;

(d) means in said frame for reciprocally mounting said roller means therein; and (e) a hammer pivotably mounted in said frame for movement from a cocked position to a fallen position, said hammer having a cam surface formed on its leading edge which is disposed to engage said roller means upon movement of said hammer to its fallen position to drive said roller means into the movement path of said recoiling breechblock to delay movement thereof to its breech opening position.

2. An automatic or semiautomatic firearm as claimed in claim 1 wherein said recoiling breechblock is provided with an angularly downwardly and forwardly inclined surface on its lower edge against which said roller means bears upon being driven into the movement path of said breechblock.

3. An automatic or semiautomatic firearm as claimed in claim 1 wherein said roller means is of cylindrical configuration.

4. An automatic or semiautomatic firearm as claimed in claim 1 wherein said means in said frame for reciprocally mounting said roller means therein comprises:

(a) a spaced apart pair of upstanding shoulders formed on the upper portion of said frame; and (b) said pair of shoulders each having a different angularly upwardly and forwardly inclined groove formed therein so as to be in aligned cofacing relationship with respect to each other.

5. An automatic or semiautomatic firearm as claimed in claim 1 wherein the cam surface of said hammer in configured to present an angularly disposed segment thereof in the movement path of said roller means when said hammer is in the fallen position thereof.

6. An automatic or semiautomatic firearm as claimed in claim 1 wherein the cam surface of said hammer is configured to present a substantially flat cam segment which is transversely positioned in the movement path of said roller means when said hammer is in the fallen position thereof.

7. An automatic or semiautomatic firearm comprising in combination:

(a) a frame;

(b) a barrel fixedly mounted on said frame;

(c) a breechblock slidably mounted on said frame for recoil movement from a breech closing position to a breech opening position upon firing of the firearm;

(d) biasing means in bearing engagement with said barrel and said breechblock for yieldingly urging said breechblock to its breech closing position;

(e) a roller mounted in said frame for reciprocal movement in a path into and out of bearing engagement with said breechblock;

(f) mounting means in said frame for reciprocally mounting said roller therein; and (g) a hammer pivotably mounted in said frame and movable between a cocked position and a fallen position to fire the firearm, said hammer having a cam surface formed on the leading edge thereof which engages said roller upon movement of said hammer toward its fallen position to drive said roller into wedged bearing engagement with said breechblock, the cam surface of said hammer configured to present a segment thereof in an angular attitude in the movement path of said roller when said hammer is in its fallen position to hold said roller in bearing engagement with said breechblock and to resistingly delay movement of said roller out of engagement with said breechblock during initial recoil movement thereof.

8. An automatic or semiautomatic firearm as claimed in claim 7 and further comprising:

(a) said breechblock having an angularly downwardly and forwardly inclined surface on its lower rear edge against which said roller bears when said hammer is in its fallen position;

(b) said roller is of cylindrical configuration; and (c) said mounting means is in the form of a pair of spaced apart grooves formed in said frame so as to be in aligned cofacing relationship with respect to each other, said pair of grooves each having a different one of the opposite ends of said roller positioned therein and said pair of grooves extending angularly downwardly and rearwardly from the recoil movement path of said breechblock.

9. An automatic or semiautomatic firearm comprising in combination:

(a) a frame;

(b) a barrel on said frame;

(c) a breechblock slidably mounted on said frame for recoil movement from a breech closing position to a breech opening position upon firing of the firearm;

(d) a hammer pivotably mounted on said frame and movable from a cocked position to a fallen position to fire the firearm;

(e) a cylinder mounted on said frame;

(f) a piston reciprocally mounted in said cylinder for movement between a first and a second position, said piston having an axially extending means for engaging said hammer and said breechblock;

(g) biasing means in said frame and in bearing engagement with said frame and the axially extending means of said piston for yieldingly urging said piston to the first position thereof and for yieldingly urging said breechblock to its breech closing position;

(h) a roller mounted in said frame for reciprocal movement into and out of bearing engagement with said breechblock;

(i) mounting means in said frame for reciprocally mounting said roller therein;

(j) said hammer having a cam surface formed on the leading edge thereof which engages said roller upon movement of said hammer to its fallen position to drive said roller into bearing engagement with said breechblock, the cam surface of said hammer having a substantially flat segment which is disposed transverse to the movement path of said roller to lock said roller in bearing engagement with said breechblock when the hammer is in its fallen position; and (k) said cylinder having a port which is coupled to the bore of said barrel so that gas pressure subsequent to firing of the firearm will move said piston to its second position to cause the axially extending means thereof to rotate said hammer toward its cocked position to move the flat segment of the cam surface of said hammer out of the movement path of said roller.

10. An automatic or semiautomatic firearm as claimed in claim 9 and further comprising:

(a) said breechblock having an angularly downwardly and forwardly inclined surface on its lower rear edge against which said roller bears when said hammer is in its fallen position;

(b) said roller being of cylindrical configuration; and (c) said mounting means is in the form of a pair of spaced apart grooves formed in said frame so as to be in aligned cofacing relationship with respect to each other, said pair of grooves each having a different one of the opposite ends of said roller positioned therein and said pair of grooves extending angularly downwardly and rearwardly from the recoil movement path of said breechblock.

11. An automatic or semiautomatic firearm comprising in combination:

(a) a frame having a first abutment and a spaced second abutment;

(b) a housing mounted on said frame for reciprocal movement from an extended position into engagement with the first abutment of said frame upon firing of the firearm, said housing having a barrel;

(c) a breechblock slidably mounted on said housing for movement from a breech closing position to a breech opening position upon firing of the firearm;

(d) biasing means in bearing engagement with said breechblock for yieldably urging said breechblock to its breech closing position and said housing to its extended position;

(e) a hammer pivotably mounted on said housing for movement from a cocked position to a fallen position to fire the firearm;

(f) a hammer strut extending from said hammer and having means for biasing said hammer to its fallen position;

(g) a roller mounted in said housing for reciprocal movement into and out of bearing engagement with said breechblock;

(h) mounting means in said housing for reciprocally mounting said roller therein;

(i) said hammer having a cam surface formed on the leading edge thereof which engages said roller upon movement of said hammer to its fallen position to drive said roller into bearing engagement with said breechblock, the cam surface of said hammer formed with a substantially flat segment which is disposed transverse to the movement path of said roller to lock said roller in bearing engagement with said breechblock when said hammer is in its fallen position; and (j) said hammer strut disposed proximate the second abutment of said frame so that upon firing of the firearm said hammer strut will move into engagement with the second abutment to pivotably move said hammer toward its cocked position to move the flat segment of the cam surface of said hammer out of the movement path of said roller.

12. An automatic or semiautomatic firearm as claimed in claim 9 and further comprising:

(a) said breechblock having an angularly downwardly and forwardly inclined surface on its lower rear edge against which said roller bears when said hammer is in its fallen position;

(b) said roller being of cylindrical configuration; and (c) said mounting means is in the form of a pair of spaced apart grooves formed in said housing so as to be in aligned cofacing relationship with respect to each other, said pair of grooves each having a different one of the opposite ends of said roller positioned therein and said pair of grooves extending angularly downwardly and rearwardly from the recoil movement path of said breechblock.

* * * * *